United States Patent [19]

Tseng

[11] Patent Number: 4,943,899

[45] Date of Patent: Jul. 24, 1990

[54] SOCKET AND BULB SNAP FASTENER FOR CHRISTMAS LIGHT STRINGS

[76] Inventor: Jeou N. Tseng, No. 17, Alley 53, Lane 167, Tung Nan St., Hsin Chu City, Taiwan

[21] Appl. No.: 446,936

[22] Filed: Dec. 6, 1989

[51] Int. Cl.[5] ..... H01R 33/00

[52] U.S. Cl. ..... 362/226; 362/382

[58] Field of Search ..... 362/226, 249, 392, 382; 439/616, 617

[56] References Cited

U.S. PATENT DOCUMENTS 3,182,185 5/1965 Ahroni et al. ..... 362/226

4,679,126 7/1987 Van Sickler ..... 362/226

*Primary Examiner*—Stephen F. Husar

*Attorney, Agent, or Firm*—Steinberg & Raskin

[57] ABSTRACT

A socket and bulb snap fastener for Christmas light strings including at least one T-shaped male member and a corresponding number of tongues. The T-shaped male member has a snapping head and is formed on an upper margin of a periphery of a socket of the bulb string for a Christmas tree. The tongue is made of insulating material and is formed in the vicinity of an upper margin of an insert of the bulb string. A rectangular slot having a width slightly less than a maximum width of the snapping head of the T-shaped male member is formed on the tongue adjacent to a free end of the tongue. A V-shaped groove is formed on a lower side of the tongue at an end opposite to the free end and extends transversely to a length of the tongue. The slot is engageable with the T-shaped male member by bending the tongue downwardly about the V-shaped groove and pushing the tongue against the T-shaped male member such that the snapping head is forced through the slot.

2 Claims, 6 Drawing Sheets

SOCKET AND BULB SNAP FASTENER FOR CHRISTMAS LIGHT STRINGS

BACKGROUND OF THE INVENTION

The present invention relates to a snap fastener and in particular to a socket and bulb snap fastener for Christmas light strings.

Decorative strings of multicolored lights are widely used around the world for decoration during many special occasions. They may be used as decoration on buildings or the like but most often are seen on Christmas trees. Although many new designs for filaments and sockets used in the strings as well as automatic assembling apparatus have been developed, an effective and secure construction of a snap fastener for securing the bulb in the socket has not yet been considered.

For example, as shown in FIG. 7, a conventional bulb and socket device in a light bulb string for a Christmas tree generally comprises a socket 90 formed with a hole 92 and a bulb 100 consisting of a lighting element 104 and an insert 102 including two leads 106 mounted on either side of the insert 102 and electrically connected to the lighting element 104. Such design provides for ease of assembly since the bulb is easily engaged with the socket 90 by inserting the insert 102 into the hole 92 of the socket 90. Nevertheless, such design is easily disconnected by sudden shock or vibration, which can occur when a string of lights hung outside swings in the wind or during transport. Moreover, in many Christmas light strings the sockets are electrically connected in series, so that the disconnection of even only one bulb breaks the electrical circuit rendering the entire string of light bulbs inoperable.

SUMMARY OF THE INVENTION

The aforedescribed problems encountered during use of known Christmas light strings are essentially avoided by the provision of the socket and bulb snap fastener for Christmas light strings in accordance with the present invention.

According to one aspect of the present invention, a socket and bulb snap fastener for Christmas light strings comprises a socket and a bulb. The bulb comprises a lighting element and an insert having two leads mounted thereon which are electrically connected to the lighting element. A hole is centrally formed on the socket for receiving the insert. The insert and the socket of the present invention are the same as prior art. The features of the socket and bulb snap fastener according to the present invention constitute at least one T-shaped male member having a snapping head being formed on an upper margin of a periphery of the socket. A corresponding number of tongues of insulating material are formed in the vicinity of an upper margin of the insert. A substantially rectangular slot is formed on each tongue adjacent to a free end of each tongue. Each slot has a width slightly less than a maximum width of the snapping head of each T-shaped male member. A V-shaped groove is formed on a lower side of each tongue at an end opposite to the free end and extending transversely to a length of each tongue. Each snapping head snappingly secures in the slot of each corresponding tongue when the tongue is bent downwardly about the corresponding V-shaped groove and pushed against each corresponding T-shaped male member such that each respective snapping head is forced through each corresponding slot.

According to another aspect of the present invention, the socket and bulb snap fastener according to the present invention is characterized in that at least one T-shaped male member having a snapping head is formed in the vicinity of an upper margin of the insert. A corresponding number of tongues of insulating material are formed on an upper margin of a periphery of the socket. A substantially rectangular slot is formed on each tongue adjacent to a free end of each tongue. Each slot has a width slightly less than a maximum width of the snapping head of the T-shaped male member. A V-shaped groove is formed on an upper side of each tongue at an end opposite to the free end and extending transversely to a length of each tongue. Each slot is engageable with each corresponding T-shaped male member by bending the tongue upwardly about the V-shaped groove and pushing each corresponding T-shaped male member such that each respective snapping head is forced through each corresponding slot.

It is therefore an object of the present invention to provide a snap fastener for a light bulb string for facilitating the engagement of the bulb in the socket.

It is another object of the present invention to provide a snap fastener which is interchangeable while retaining the same securing function.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENTS

Figure 1:
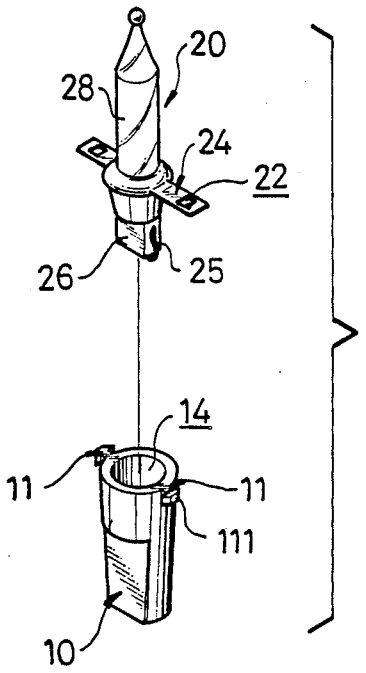
FIG. 1 is an exploded perspective view of a socket and bulb snap fastener for Christmas light strings in accordance with the present invention.
Figure 3:
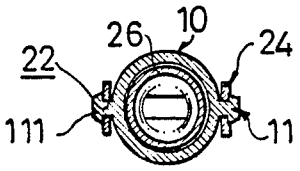
FIG. 3 is a cross-sectional view taken along line 3—3 in FIG. 2 as seen from above showing the secured position.
Figure 2:
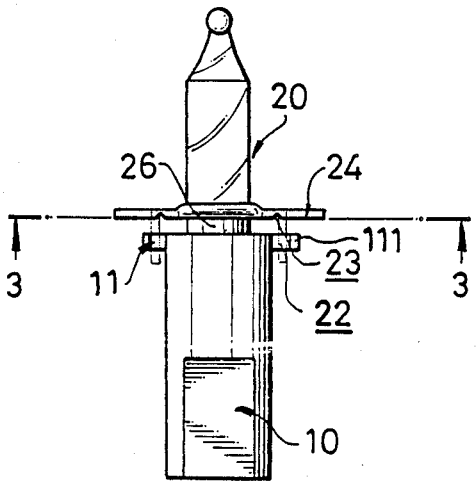
FIG. 2 is a side view of the socket and bulb snap fastener of FIG. 1 in accordance with the present invention showing the securing effect of the snap fastener.

Referring to FIGS. 1, 2 and 3, a socket and bulb snap fastener for Christmas trees comprises a socket 10 and a bulb 20. The bulb 20 comprises a lighting element 28 and an insert 26 having two leads 25 mounted thereon (only one lead is shown) which are electrically connected to the lighting element 28. A hole 14 is centrally formed on the socket 10 for receiving the insert 26. The socket 10 and the bulb 20 are the same as prior art. The snap fastener according to the present invention is characterized in that two T-shaped male members 11 each having a snapping head 111 are formed on diametrically opposed portions of an upper margin of a periphery of the socket 10.

Two tongues 24 of insulating material are respectively formed, relative to the two T-shaped male members 11, in the vicinity of an upper margin of the insert 26. A substantially rectangular slot 22 is formed on each tongue 24 adjacent to a free end of each tongue 24. The slot 22 has a width slightly less than a maximum width of the snapping head 111 of the T-shaped male member 11. As shown in FIG. 2, a V-shaped groove 23 is formed on a lower side of each corresponding tongue 24 at an end opposite to the free end and extending transversely to a length of each tongue 24. Each slot 22 is snappable with each corresponding T-shaped male member 11 by bending the respective tongues 24 downwardly about the V-shaped groove 23 and pushing the tongue 24 against the T-shaped male member 11 such that the respective snapping head 111 is forced through the slot 22. Accordingly, the T-shaped male member 11 snaps into the slot 22 as shown by the phantom line in FIG. 2 (see FIG. 3 for reference).

Figure 4:
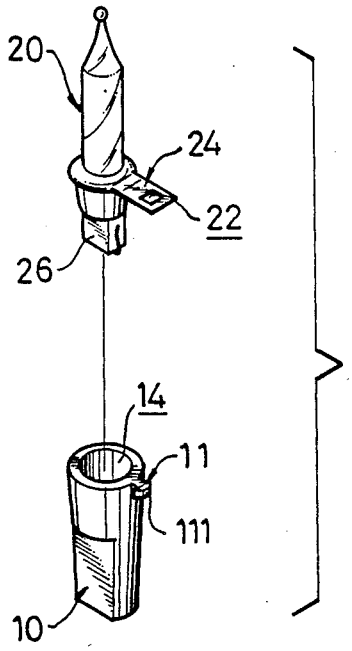
FIG. 4 is an exploded perspective view of another preferred embodiment of a socket and bulb snap fastener for Christmas light strings according to the present invention, wherein a single tongue and a T-shaped male member are utilized.

Referring to FIG. 4, the securing function of the snap fastener also can be achieved by providing merely a T-shaped member 11 on the socket 10 and a tongue 24 on the bulb 20.

Figure 5:
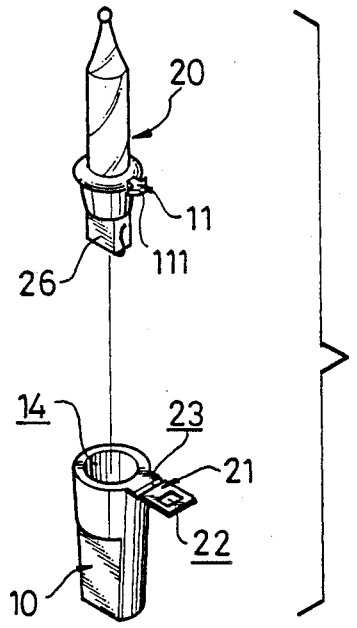
FIG. 5 is an exploded perspective view showing another preferred embodiment of the present invention, wherein the position of the tongue and the T-shaped male member in FIG. 4 are interchanged.

Referring to FIG. 5, alternatively, the T-shaped male member 11 having the snapping head 111 is formed in the vicinity of the upper margin of the insert 26. The tongue 24 of insulating material is formed on the upper margin of the periphery of the socket 10. Similarly, a rectangular slot 22 having a width slightly less than a maximum width of the snapping head 111 of the T-shaped male member 11 is formed on the tongue 24 adjacent to the free end of the tongue 24. A V-shaped groove 23 is formed on an upper side of the tongue 24 at an end opposite to the free end and extending transversely to a length of the tongue 24. The slot 22 is engageable with the T-shaped male member 11 by bending the tongue 24 upwardly about the V-shaped groove 23 and pushing the tongue 24 against the T-shaped male member 11 such that the respective snapping head 111 is forced through the slot 22.

Figure 6:
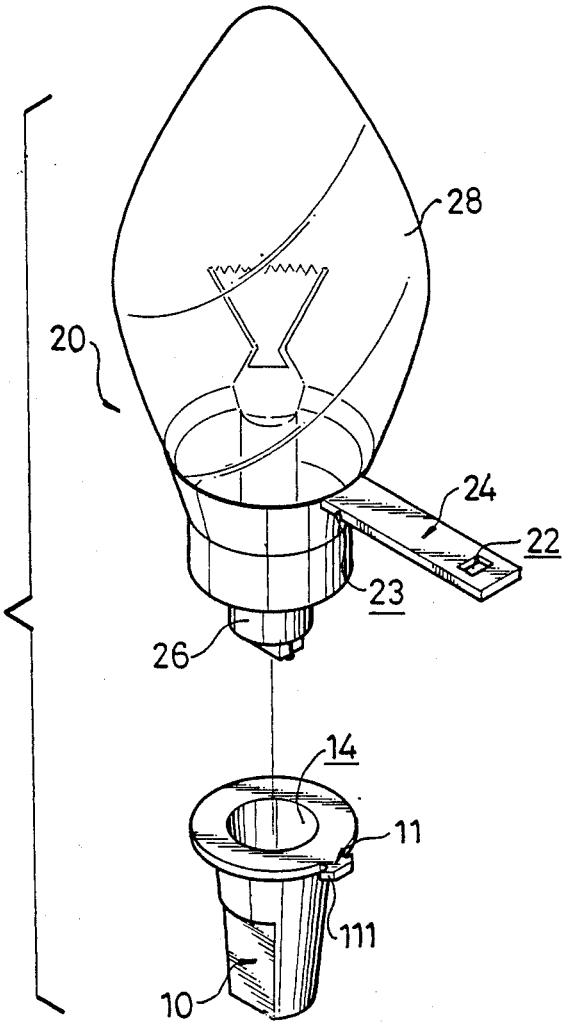
FIG. 6 is an exploded perspective view of the socket and bulb snap fastener in accordance with the present invention utilized in conjunction with a large bulb string for Christmas trees.
Figure 7:
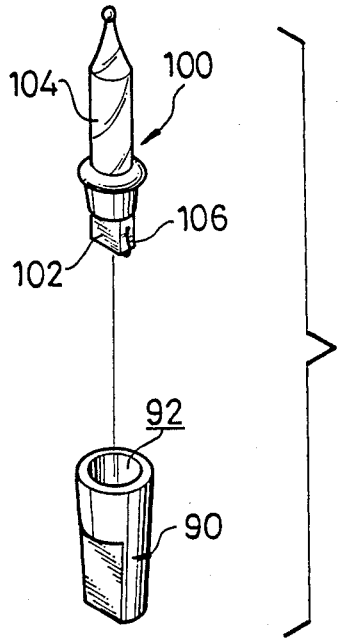
FIG. 7 PRIOR ART
FIG. 7 is an exploded perspective view of a conventional socket and bulb device for Christmas trees.

Referring to FIG. 6, the socket and bulb snap fastener in accordance with the present invention can also be applied on a Christmas light string with large bulbs. The same securing function can be achieved with the provision of the T-shaped male member 11 and the tongue 24, and needs no further explanation.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A socket and bulb snap fastener for Christmas light strings, comprising a socket and a bulb, said bulb comprising a lighting element and an insert having two leads mounted thereon which are electrically connected to said lighting element, a hole being centrally formed on said socket for receiving said insert, said socket and bulb snap fastener being characterized in that said socket and bulb snap fastener further comprises:

at least one T-shaped male member having a snapping head being formed on an upper margin of a periphery of said socket;

a corresponding number of tongues of insulating material being formed, relative to each said T-shaped male member, in the vicinity of an upper margin of said insert, a substantially rectangular slot having a width slightly less than a maximum width of said snapping head of said T-shaped male member being formed on each said tongue adjacent to a free end of each said tongue, a V-shaped groove being formed on a lower side of each said tongue at an end opposite to said free end and extending transversely to a length of each said tongue, each said slot being engageable with each corresponding said T-shaped male member by bending said tongue downwardly about said V-shaped groove and pushing each said tongue against each corresponding said T-shaped male member such that each respective said snapping head is forced through each corresponding said slot.

2. A socket and bulb snap fastener for Christmas light strings, comprising a socket and a bulb, said bulb comprising a lighting element and an insert having two leads mounted thereon which are electrically connected to said lighting element, a hole being centrally formed on said socket for receiving said insert, said socket and bulb snap fastener being characterized in that said socket and bulb snap fastener further comprises:

at least one T-shaped male member having a snapping head being formed in the vicinity of an upper margin of said insert;

a corresponding number of tongues of insulating material being formed, relative to each said T-shaped male member, on an upper margin of a periphery of said socket, a substantially rectangular slot having a width slightly less than a maximum width of said snapping head of said T-shaped male member being formed on each said tongue adjacent to a free end of each said tongue, a V-shaped groove being formed on an upper side of each said tongue at an end opposite to said free end and extending transversely to a length of each said tongue, each said slot being engageable with each corresponding said T-shaped male member by bending each said tongue upwardly about said V-shaped groove and pushing each said tongue against each corresponding said T-shaped male member such that each respective said snapping head is forced through each corresponding said slot.

* * * * *